US007467726B1

(12) United States Patent
Izraelev

(10) Patent No.: US 7,467,726 B1
(45) Date of Patent: Dec. 23, 2008

(54) COMBINATION BEVERAGE CONTAINER AND DRINKING VESSEL

(76) Inventor: Valentin Izraelev, 6574 Cherokee Trail West, Eden Prairie, MN (US) 55344

( * ) Notice: Subject to any disclaimer, the term of this patent is extended or adjusted under 35 U.S.C. 154(b) by 741 days.

(21) Appl. No.: 10/859,676

(22) Filed: Jun. 2, 2004

(51) Int. Cl.
*B65D 23/10* (2006.01)

(52) U.S. Cl. ..... 215/396; 220/758

(58) Field of Classification Search ..... 215/376, 215/377, 396; 220/758, 737, 739, 311.3, 220/915.1; 248/311.2; 294/29, 30, 145, 294/146

See application file for complete search history.

(56) References Cited

U.S. PATENT DOCUMENTS

| | | | | | |
|---|---|---|---|---|---|
| 237,505 | A * | 2/1881 | Eason | 215/42 |
| 640,860 | A * | 1/1900 | Baum, Jr. | 215/377 |
| 840,860 | A * | 1/1907 | Baum, Jr. | 210/432 |
| 2,028,566 | A * | 1/1936 | Seipel et al. | 294/31.2 |
| 2,086,404 | A * | 7/1937 | Daniels | 215/377 |
| 2,605,945 | A * | 8/1952 | Dechar | 294/146 |
| 2,700,249 | A * | 1/1955 | Miller | 446/81 |
| 2,838,202 | A * | 6/1958 | Huether | 220/741 |
| 2,990,080 | A * | 6/1961 | Harris | 215/228 |
| 3,107,028 | A * | 10/1963 | De Robertis | 220/212 |
| 3,369,687 | A * | 2/1968 | Walls | 215/10 |
| 3,482,731 | A * | 12/1969 | Douty | 220/630 |
| 4,817,810 | A * | 4/1989 | Shull | 220/741 |
| 5,765,716 | A * | 6/1998 | Cai et al. | 220/740 |
| 6,047,852 | A * | 4/2000 | Evans et al. | 220/793 |
| 6,070,755 | A * | 6/2000 | Evans et al. | 220/793 |
| 6,164,473 | A * | 12/2000 | Waldrip | 215/378 |
| 6,378,924 | B1 * | 4/2002 | McCrumb | 294/28 |
| 6,398,050 | B1 * | 6/2002 | Allora | 215/228 |

* cited by examiner

*Primary Examiner*—Sue A Weaver
(74) *Attorney, Agent, or Firm*—Mark J. Burns; Haugen Law Firm PLLP

(57) ABSTRACT

Beverage container which converts to offer mug-like presentation of the liquid contents. An open bottom container screwingly seals to the base of a cylindrical shaped handle member. The beverage container is inverted and the handle member is disengaged from the open bottom container. Subsequently, the neck area of the open bottom container is brought into engagement with the cylindrical shaped handle member to present an open mug-like beverage container. An alternate embodiment discloses a beverage container having deployable handles.

3 Claims, 11 Drawing Sheets

COMBINATION BEVERAGE CONTAINER AND DRINKING VESSEL

FIELD OF INVENTION

The present invention is for a beverage container, and more particularly, pertains to a beverage container which converts to an open mug-like container.

BACKGROUND OF THE INVENTION

Prior art beverage containers have typically require pouring of a beverage into a container which, at least perceptionally, causes changes in the taste of the beverage.

The present invention does not require any pouring of the beverage and very easily converts the container into a glass for drinking of the beverage.

SUMMARY OF THE INVENTION

The general purpose of the present invention is a beverage container.

According to one embodiment of the present invention, there is provided a beverage container, including an open bottom glass bottle container having screw threads at the lower end and an upper neck region having a cap and a locking flange aligned below the cap. Also included is a handle member having an open side, an upper cylindrical portion, and a base member contiguous with the upper cylindrical portion. The base member includes a central lower cylindrical cavity, a wall member surrounding the lower cylindrical cavity, locking grooves aligned within the wall member, an annular threaded cavity, and a seal member for sealing the bottle container to the handle member.

The container is opened by inverting the assembly, unscrewing the base member from the glass bottle, and inserting the top of the glass container into the base member, leaving a mug-like opening at top from which the contents of the container may be consumed.

The geometric structure of the beverage container is appropriately sized to conform to be compatible with existing filling and processing methods and devices, and with shipping containers to eliminate or minimize the need for retooling and resizing of such processing components.

The beverage container provides for quick and convenient access to the beverage container liquid contents with a minimum of effort. A wide mouth mug lip or surface replicates that of a mug. The base of the handle members also provides for a wider and more stable support than does the base of a common beverage containment bottle. Purists who maintain that liquid quality of a beverage is degraded by pouring of certain types of liquid refreshment from a contain to a mug will readily appreciate the fact that the container is, in fact, also a mug. It is also appreciated that a wide lip or rim similar to that of a mug is provided and is deemed to be more significantly superior to imbibing a liquid through the narrow filler neck. One significant aspect and feature of the invention is a beverage container which converts to a mug-like beverage container.

Another significant aspect and feature of the present invention is a bottle-like container which engages a handle member and closely simulates the profile of a common beverage container such as that used to contain or dispense liquid refreshment.

Yet another significant aspect and feature of the present invention is a container member having an open bottom which seemingly engages with the base of a handle member.

Still another significant aspect and feature of the present invention is a container member having a locking flange and/or tabs at the upper portion of the container neck.

An additional significant aspect and feature of the present invention is a handle member having an upper cylindrical portion extending from a base member.

Another additional significant, aspect and feature of the present invention is a base member having a central cavity for secure accommodation of the cap and flange members of the container neck member.

A further significant aspect and feature of the present invention is an annular cavity at the base of the container which, when inverted and properly utilized, closely resembles in size and shape the top lip of a mug container.

Still further significant aspect and feature of the present invention is that the liquid contents of the beverage container does not have to be poured, such as from a common bottle, into a mug, thereby using its own structure to serve as a mug.

Another significant aspect and feature of the present invention is a beverage container having deployable handles which pivot and lock to each other to form one handle member. Having thus described embodiments of the present invention, it is the principal object of the present invention to provide a beverage container.

One object of the present invention is a beverage container which converts for self use as a mug-like container.

Another object of the present invention is a beverage container which is returnable

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the Figures thereof and wherein:

FIG. 1 illustrates a cutaway view in cross section of a beverage container;

DETAILED DESCRIPTION OF THE PREFERRED EMBODIMENTS

FIG. 1 illustrates a cutaway view in cross section of a beverage container 10, which readily converts to a mug. The major components of the beverage container 10, which can also be used for a variety of liquid refreshment, include a container 12 and a handle member 14. The container 12 threadingly engages the handle member 14.

Figure 5:
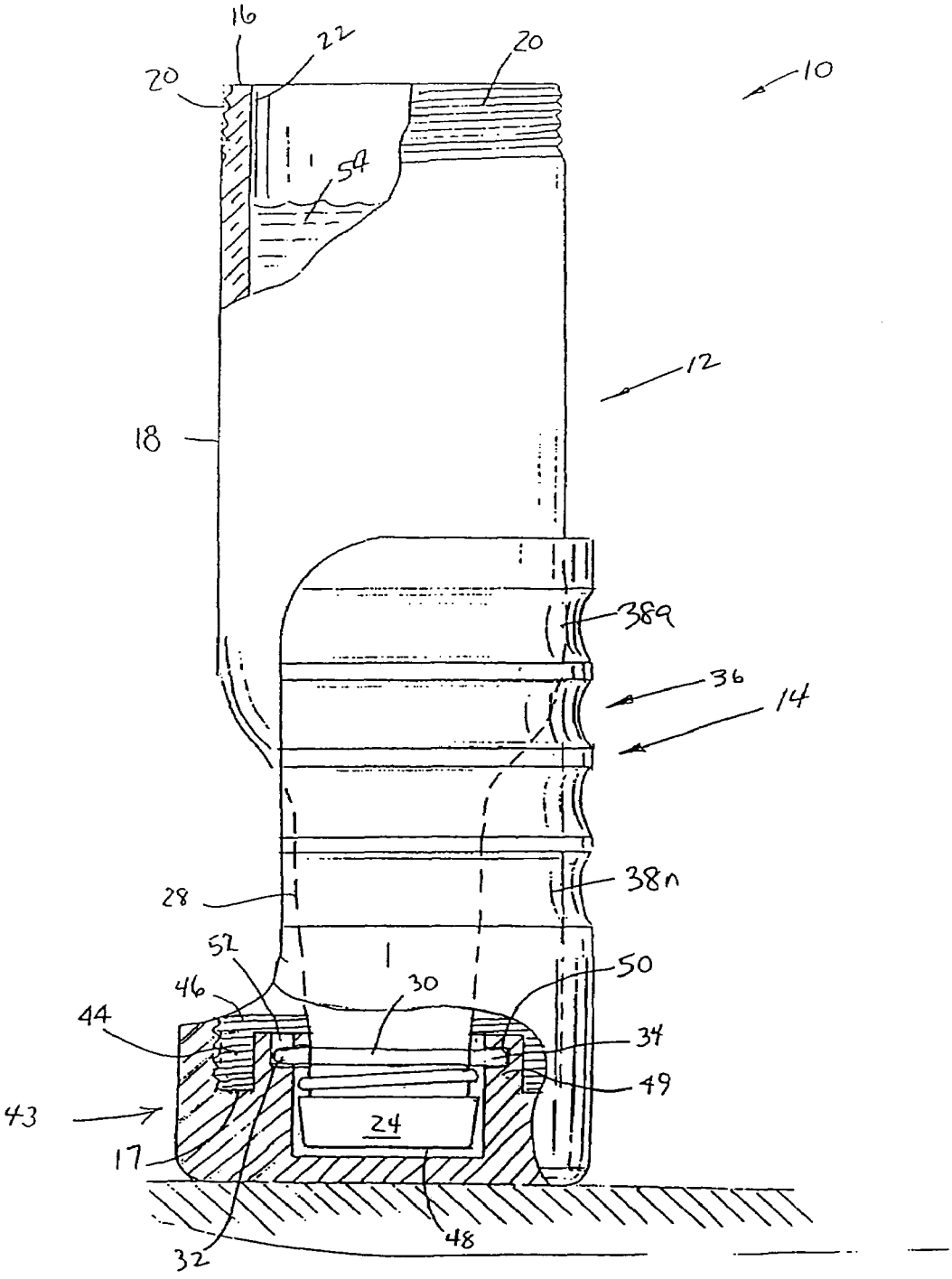
FIG. 5 illustrates the mating of the container with the handle.

The profile of the container 12, in general, resembles that of a beverage bottle container, but includes several differences. An annular lip 16 is located at the bottom of the container cylindrical portion 18. An externally threaded surface 20 aligns at the lower external portion of the container cylindrical portion 18 in intersection with the lip 16. Lip 16 seals against a suitable seal 19 aligned to a recessed annular surface 17 which is located inwardly from the externally threaded surface 20 and outwardly from a cylindrical wall 49 surrounding a cylindrical cavity 48. A large cylindrical orifice 22, as illustrated in FIG. 5, is located central to the lip 16. At the opposing end, cap 24 threadingly engages a threaded surface 26 at the upper end of the container neck 28. A circular flange 30, including locking tabs 32 and 34, is located below the threaded surface 26 on the container neck 28 and is integral to the container neck 28.

The handle member 14 is substantially cylindrical in shape and conforms generally to the shape of the container cylindrical portion 18 of the container 12. An upper cylindrical portion 36 of the handle member 14 includes a plurality of horizontally aligned gripping grooves 38*a*-38*n*. The upper cylindrical portion 36, as viewed from above, describes an arc of approximately 270 degrees for purpose of example and illustration, and includes a continuous edge 40 which defines an opening 42 at one side of the handle member 14. The arc can be almost any suitable arcular range from approximately 30 degrees to 360 degrees, if desired. An integral base 43 at the lower area of the handle member 14 includes various members for engaging either end of the container 12. Firstly, an annular cavity 44, having an internally threaded surface 46, is included in the base 43 to engage the externally threaded surface 20 of the container 14 to threadingly and mutually lock and seal the container 12 and the handle member 14 together. Secondly, a cylindrical cavity 48 having locking grooves 50 and 52 located in surrounding cylindrical wall 49, is located in the base 43 to engage tabs 32 and 34 of flange 30 as later described in detail.

Figure 2:
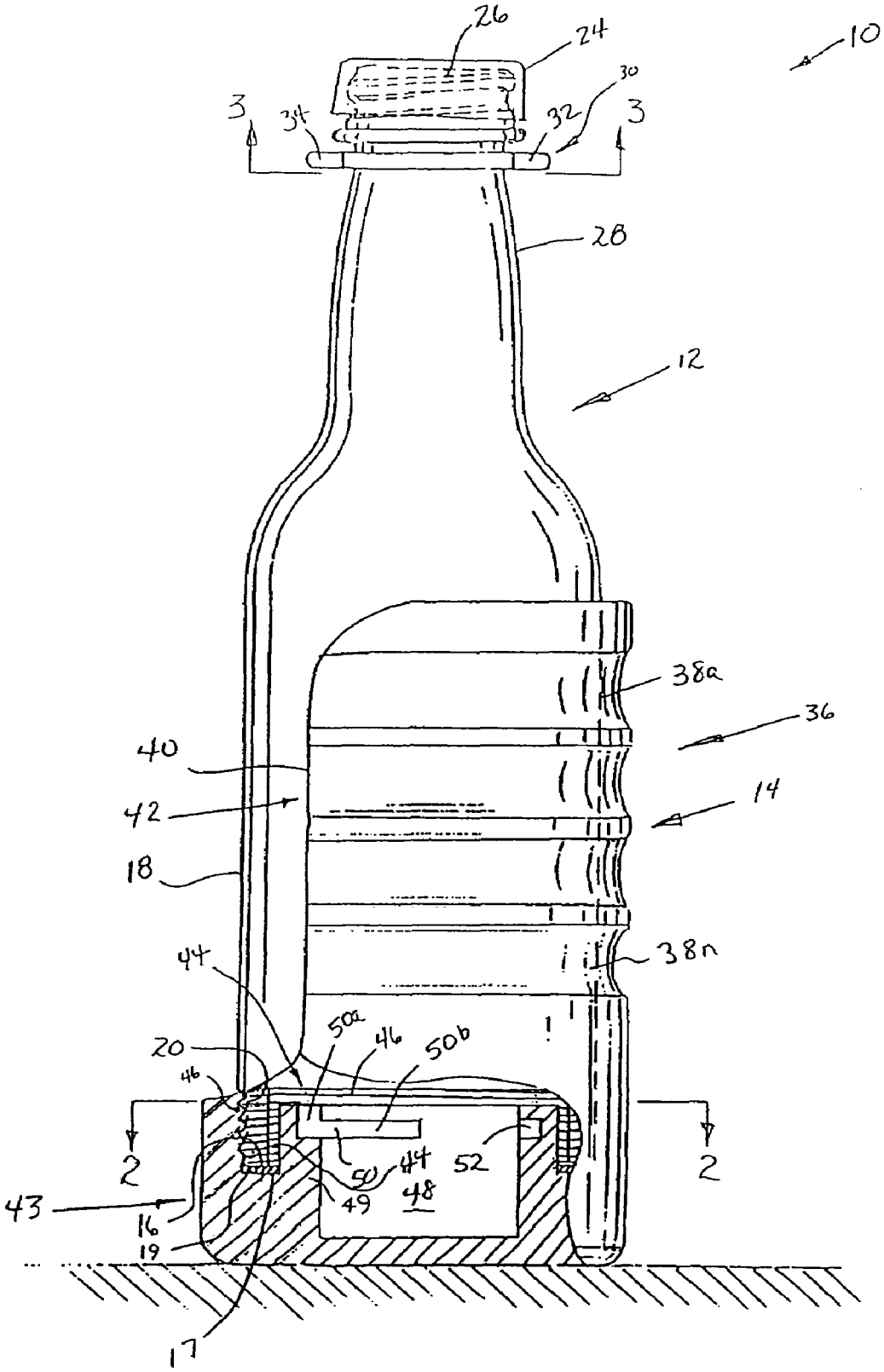
FIG. 2 illustrates a cross sectional view of the base along line 2-2 of FIG. 1.
Figure 2:
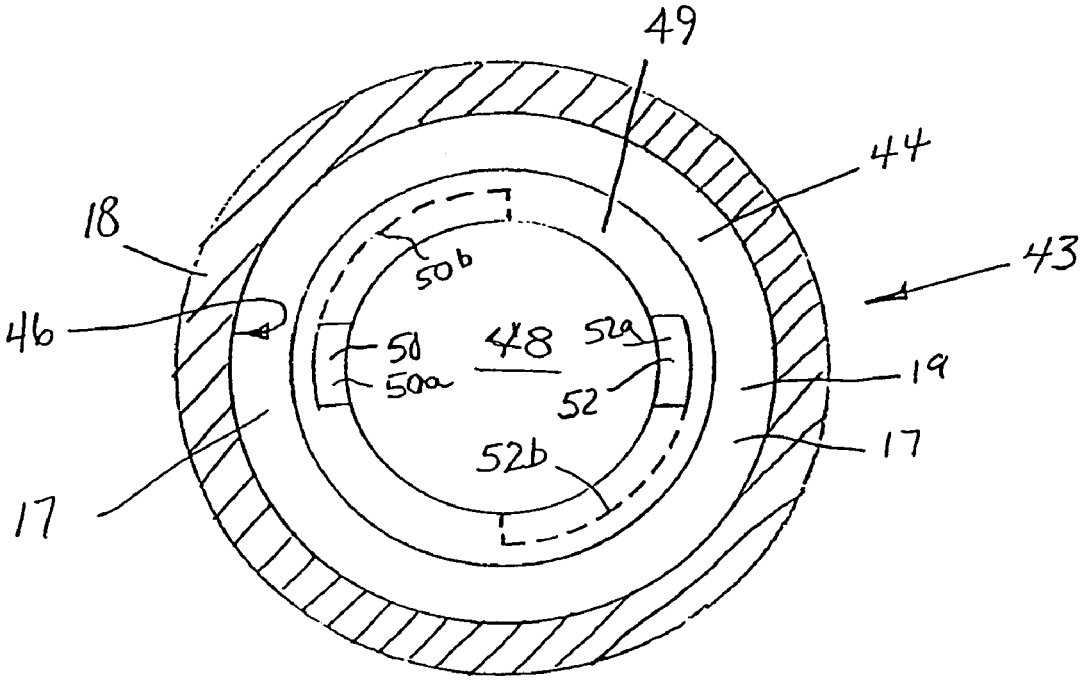

FIG. 2 illustrates a cross sectional view of the base 43 along line 2-2 of FIG. 1 where all numerals correspond to those elements previously described. Illustrated in particular and with reference to FIG. 5 is locking groove 50 which includes a vertical recess 50*a* intersecting a horizontal recess 50*b* and, in the same manner, a locking groove 52 which includes a vertical recess 52*a* intersecting a horizontal recess 52*b*. Locking grooves 50 and 52 accommodate the locking tabs 34 and 32, at the upper portion of the container neck 28 illustrated in FIG. 1. The horizontal recesses 50*b* and 52*b* can be ramped to provide a higher pressure fit if desired.

Figure 3:
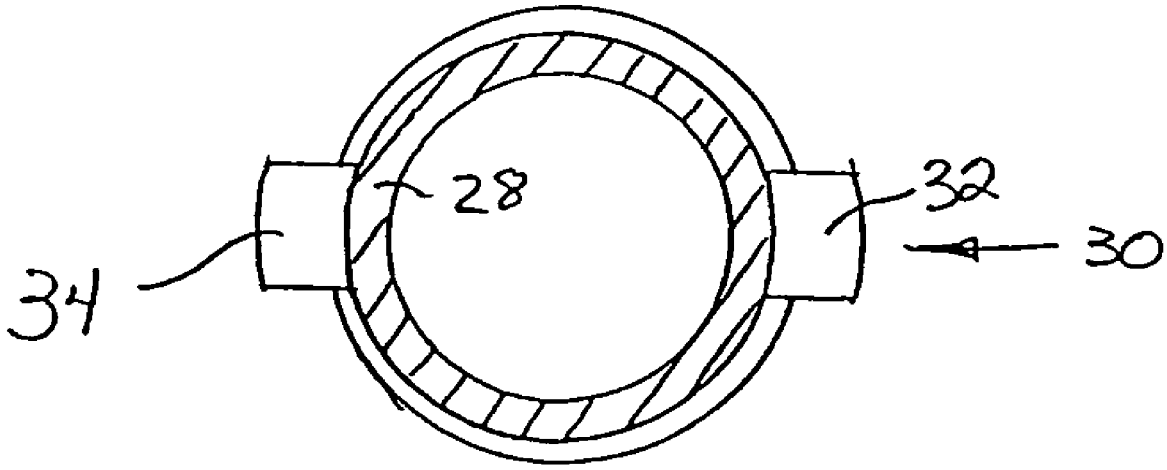
FIG. 3 illustrates a cross section of the neck along line 3-3 of FIG. 1.

FIG. 3 illustrates a cross section of the container neck 28 along line 3-3 of FIG. 1 where all numerals correspond to those elements previously described. Illustrated in particular are the locking tabs 32 and 34 located on flange 30.

Mode of Operation

Figure 4:
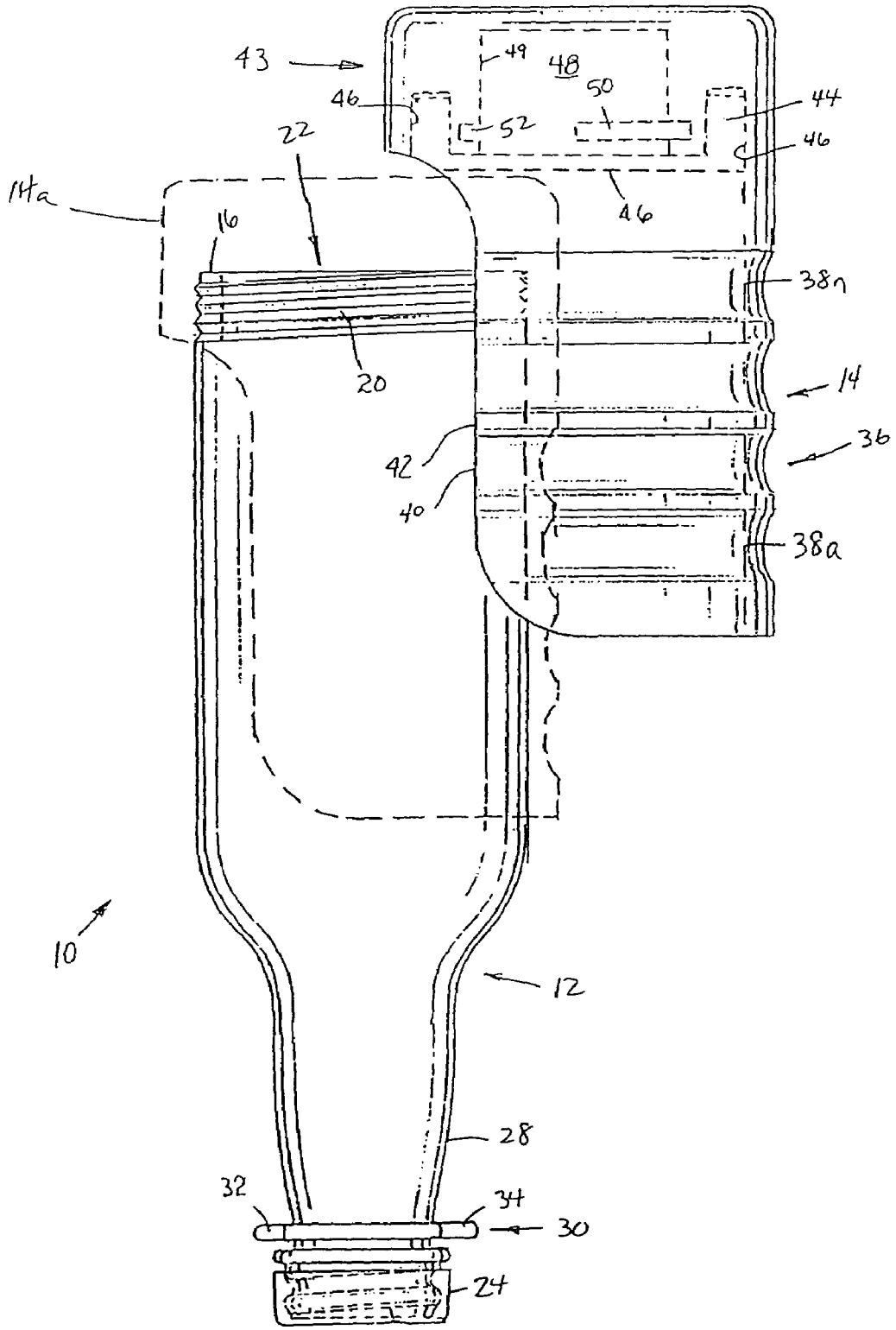
FIG. 4 illustrates the removal of the handle from the container.

FIGS. 4 and 5 best illustrate the mode of operation of the beverage container 10 where all numerals correspond to those elements previously described. The beverage container 10 is first inverted. The handle member 14, illustrated in dashed lines about the container 12 as 14*a*, is rotated to disengage the threaded surface 20 of the container 12 from the threaded surface 46 of the base 43 of the handle member 14 to reveal the cylindrical cavity 22, the lip 16 and the liquid contents 54 in the cylindrical cavity 22, such as, /but not limited to, beer. The handle member 14 is then removed from the area of the lip 16 and cylindrical cavity 22 and inverted and secured in a position such as illustrated in FIG. 5. The container 12 is inserted within the inner circumferential confines of the handle member 14 so that the cap 14 and threads 26 occupy the cylindrical cavity 48 and the locking tabs 32 and 34 at the lower end of the neck 28 appropriately engage the locking grooves 52 and 50 in the base 43. The container 12 is then rotated to cause locking of tabs 32 and 34 to be seated deep into the horizontal recesses 52*b* and 50*b* (illustration in FIG. 2) causing locking engagement of the container 12 to the handle member 14. Although locking tabs 30 and 32 at one end of the container 12 are illustrated and described in locking engagement with locking grooves 50 and 52 in the base 43, any suitable engagement methods can be utilized to appropriately secure and/or engage the smaller end of the container 12 with the base member 43 of the handle 14. These methods can include, but are not limited to, opposing thread engagement, flexible ramped snap rings and grooves, and the like. Thus, the beverage container 10 is provided with a stable base and an open mouth large cylindrical orifice much similar to that of a beer glass or mug.

First Alternative Embodiment

Figure 6:
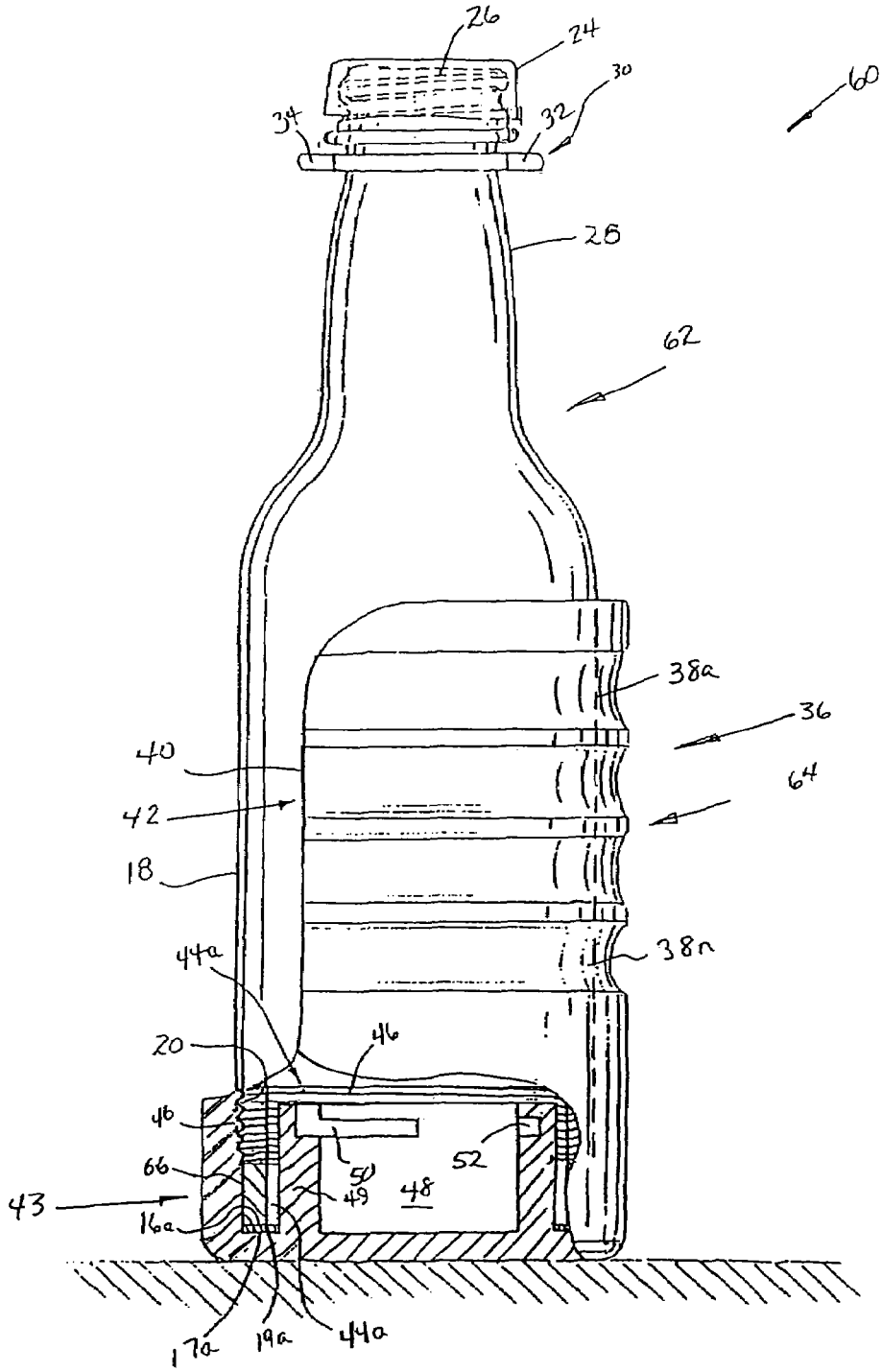
FIG. 6, a first alternative embodiment, illustrates a beverage container having an extended bottom area.

FIG. 6, a first alternative embodiment, illustrates a beverage container 60 featuring a container 62 having an extended bottom area and a handle member 64 having a deepened annular cavity to present a smooth lip contact area where all numerals correspond to those elements previously described. Annular cavity 44, previously illustrated in FIG. 1 and now designated as annular cavity 44*a*, is extended and deepened below the level of the internally threaded surface 46 toward the bottom of the base 43 and includes a repositioned recessed annular surface 17*a*. The lower container cylindrical portion 18 having a lip 16 at its lower most edge and the threaded surface 46 previously illustrated in FIG. 1, is extended below the area of the internally threaded surface 46 previously illustrated in FIGS. 1 and 2. Lip 16 is newly designated as lip 16*a*. A seal 19*a* aligns between lip 16*a* and the recessed annular surface 17*a*. A smooth cylindrical-like band area 66 is located between the threaded surface 46 and the lip 16*a* presents a smooth surface suitable for contact with a user's lips and mouth.

Second Alternative Embodiment

Figure 7:
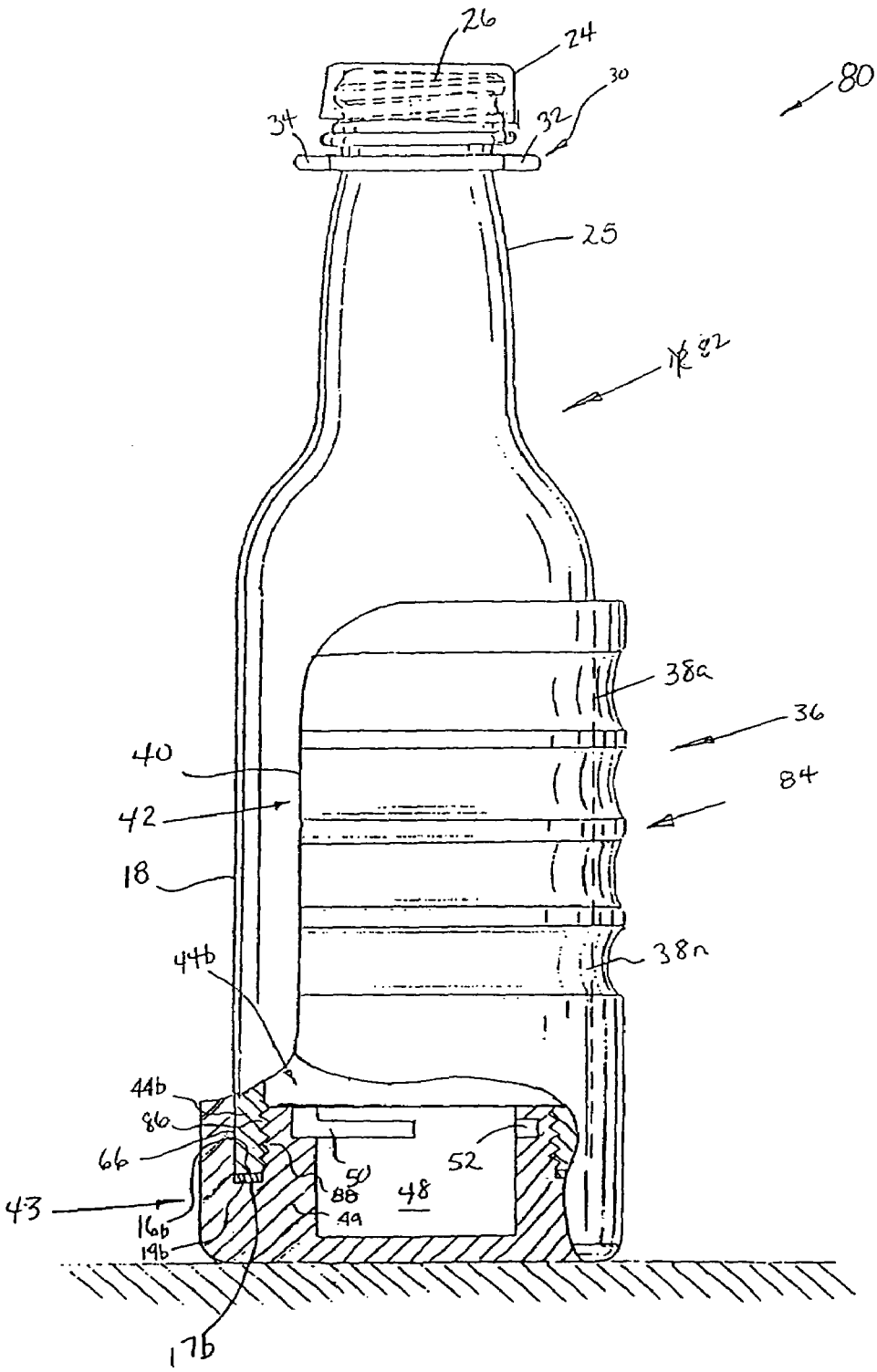
FIG. 7, a second alternative embodiment, illustrates a beverage container having internally positioned threads and a continuous smooth presentation surface.

FIG. 7, a second alternative embodiment, illustrates a beverage container 80 featuring internally positioned threaded members which provide for securing of a container 82 to a handle 84 without the presentation of a threaded surface to the user where all numerals correspond to those elements previously described. The container cylindrical portion 18 extends as a continuous smooth surface without the inclusion of previously illustrated external threaded surface 20 and extends to a lip 16*b*, formerly designated lip 16 on FIG. 1. Internal threads 86 extend upwardly an appropriate distance from the lip 16*b* on the inner surface of the container cylindrical portion 18. The outer surface of cylindrical wall 49, which surrounds the cylindrical cavity 48, includes an externally threaded surface 88 which corresponds to and engages internal threads 86 on the inner surface of the container cylindrical portion 18. A seal 17*b* is located between lip 16*b* and a recessed surface 17*b* at the bottom of annular cavity 44*b* previously designated as annular cavity 44

Third Alternative Embodiment

Figure 8:
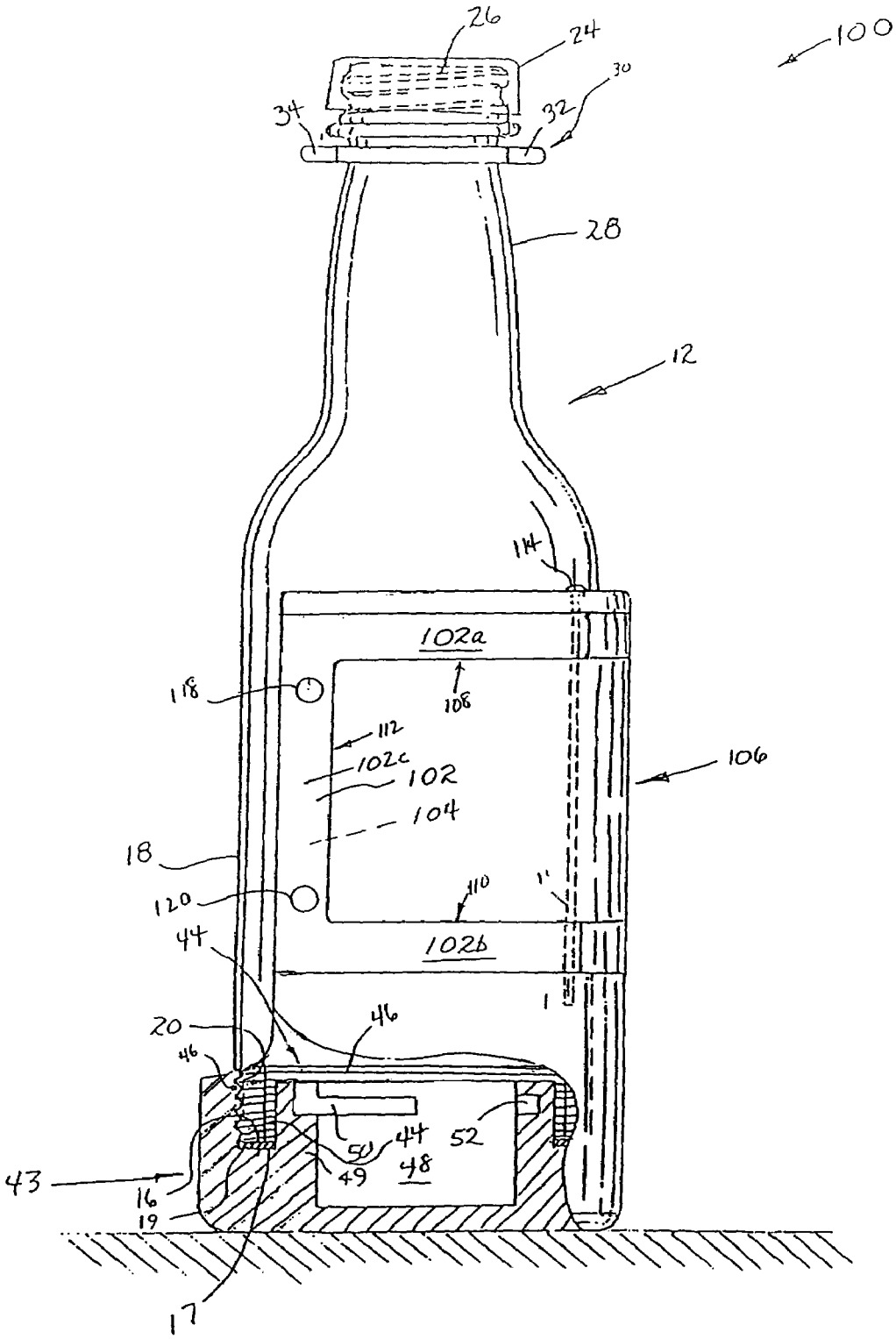
FIG. 8, a third alternative embodiment, illustrates a beverage container having deployable handles.

FIG. 8, a third alternative embodiment, illustrates a beverage container 100 incorporating the majority of features and attributes of previously described beverage container 10 where all numerals correspond to those elements previously described. Opposing flush and deployable handle members 102 and 104 secure to an upper cylindrical member 106 which is incorporated in place of the upper cylindrical portion 36 included in previous Figures. The upper cylindrical member 106 extends integrally to form the base member 43. Flush and deployable handle members 102 and 104 align in Formed recesses 108, 110 and 112 in the cylindrical member 106. Recesses 108, 110 and 112 can be either backed recesses or clear cut recesses as desired. U-shaped handle 102, being similar in most respects to opposing handle 104, includes horizontal members 102*a* and 102*b*, and interceding vertical member 102*c* disposed therebetween. Horizontal members 102*a*, 102*b* and 102*c* are segments of arcs conforming to the curvature of the container cylindrical portion 18 and align in recesses 108, 110 and 112 respectively. Pivot pin 114 pivotally secures the pivotal ends of horizontal handle members 102*a* and 102*b* to the cylindrical member 106. A plurality or male snap members 118 and 120 extend from the vertical handle member 102*c* to engage corresponding female snap recesses 122 and 124 included in the mating deployable handle member 104 upon handle deployment as illustrated in FIG. 11.

Figure 9:
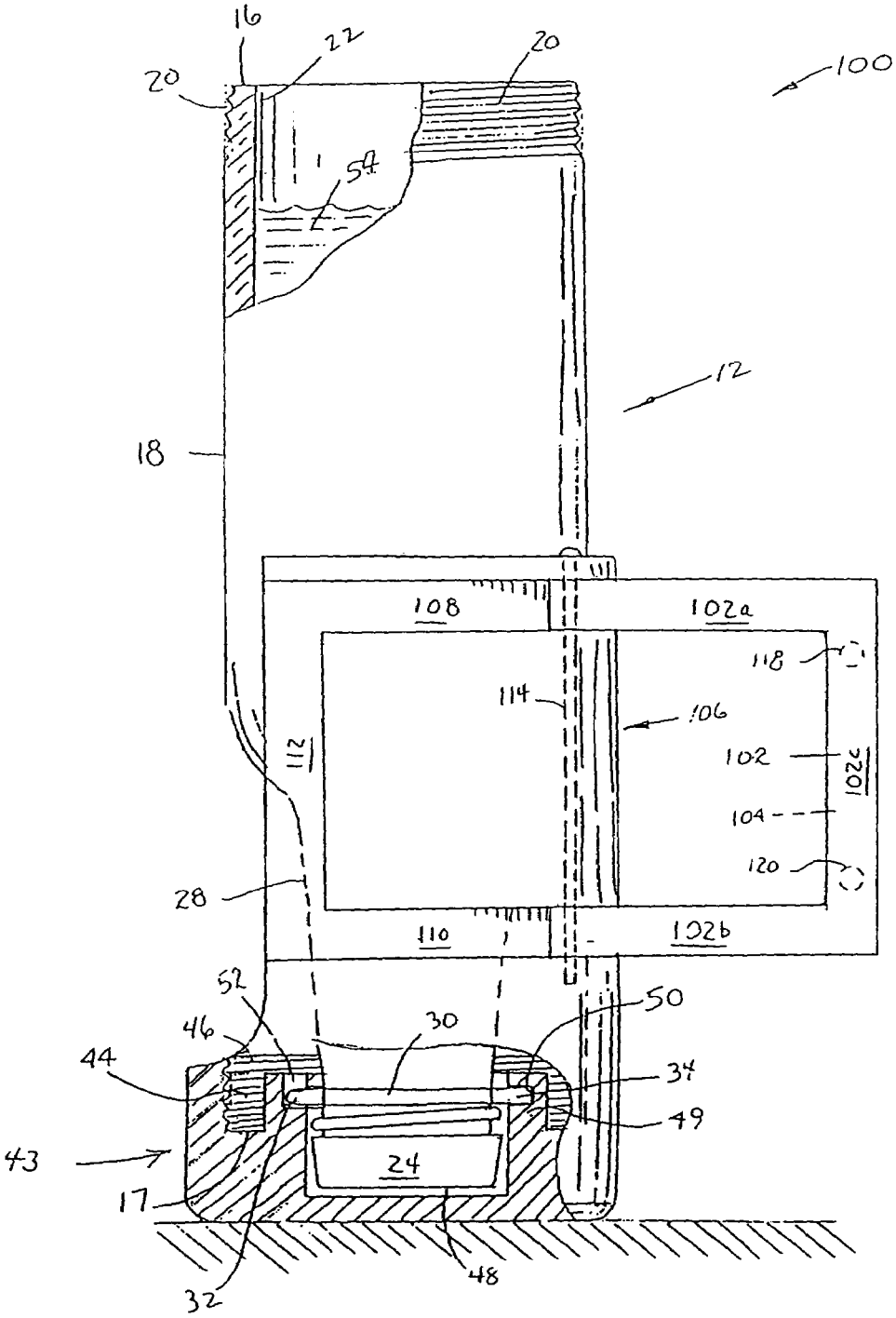
FIG. 9 illustrates the beverage container handles in a deployed position.

FIG. 9 illustrates a side view of the deployable handles 102 and 104 pivotally positioned to meet at the vertical portions of the handles 102 and 104 such as vertical handle member 102*c* of handle 102 with the corresponding vertical handle member (not illustrated) of deployable handle 104 where all numerals correspond to those elements previously described.

Figure 10:
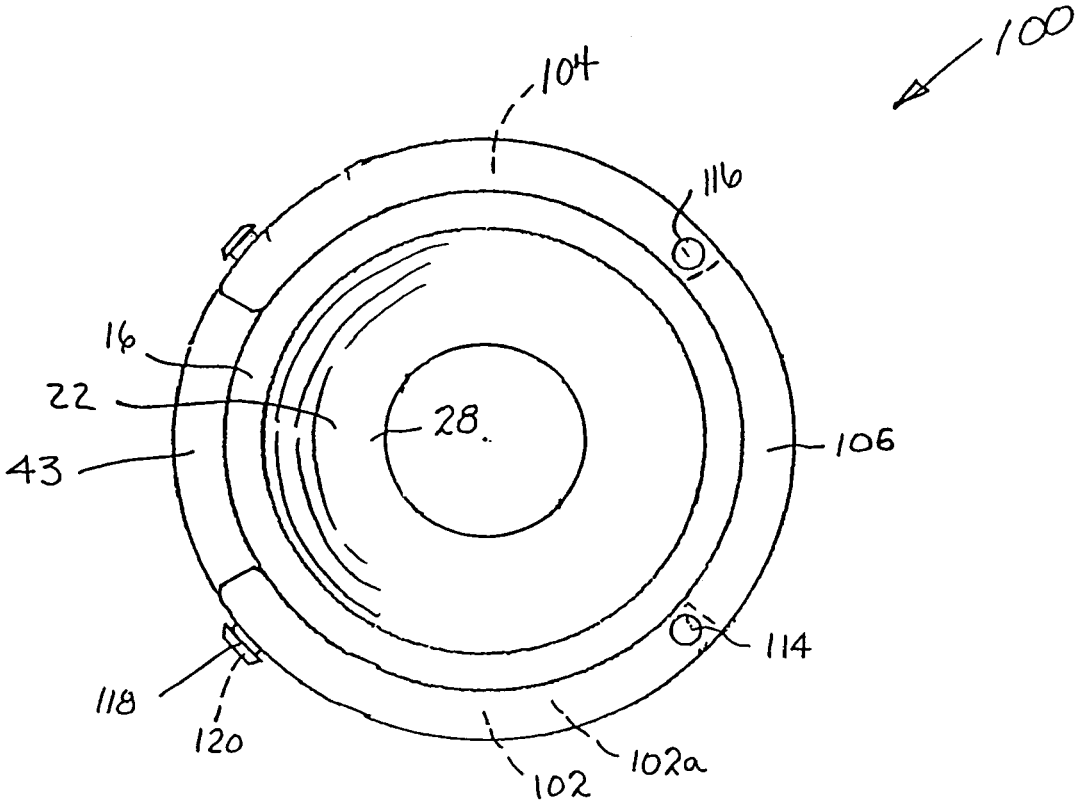
FIG. 10 illustrates a top view of the beverage container with the handles stowed.

FIG. 10 illustrates a top view of the beverage container 100 with stowed handles where all numerals correspond to those elements previously described.

Figure 11:
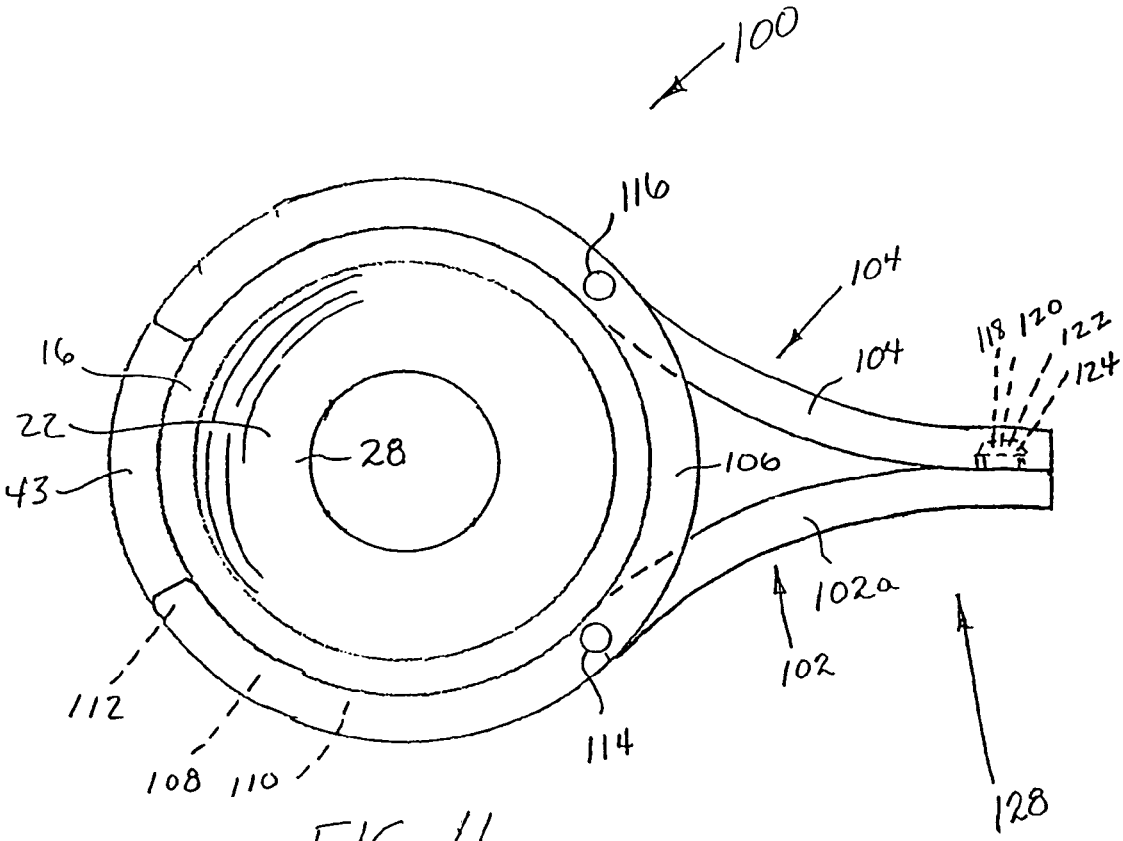
FIG. 11 illustrates a top view of the beverage container with the handles deployed.

FIG. 11 illustrates a top view of the beverage container 100 with deployed handles where all numerals correspond to those elements previously described. Deployed handles 102 and 104 have been pivoted about pivot pins 114 and 116 to form, in essence, a single joined handle member 128 which is formed by deployable handles 102 and 104. Male snap members 118 and 120 snappingly engage female snap members 122 and 124 respectively to join the deployable handles 102 and 104.

Mode of Operation

With reference to FIGS. 1, 4 and 5 the mode of operation is now described.

FIG. 1 illustrates the beverage container 10 in the conventional shipping position with the cap 24 engaging the threaded surface 26 of the container neck 28 and the external threaded surface 20 at the lower region of the container cylindrical portion 18 engaging the internally threaded surface 46 of the base 43 to effect a seal between lip 16 of the cylindrical portion 18 and the recessed annular surface 17 of the base 43 via seal 19.

With reference to FIG. 4, the beverage container 10 is inverted and the handle member 14 is rotated to disengage the external threaded surface 20 of the container cylindrical portion 18 from the internally threaded surface 46, of the base 43 in handle 14 whereby the handle 14 is removed from over and about the lip 18 and the cylindrical container portion 18. The handle 14 is then inverted and the container 12 is inserted into the handle 14 as illustrated in FIG. 5. The cap 24 and flange 30 are inserted into the cylindrical cavity 48 whereby the container 12 is rotated to cause the members 32 and 34 of flange 30 to engage the horizontal recesses 52*b* and 50*b* in the cylindrical wall 49 to secure the container 12 to the handle member 14. In this process the container cylindrical portion 18 is brought into contact with the inner walls of the handle 14 for additional container 12 support. Thus, a beverage container is readied for contents of a beverage container therein.

Various modifications can be made to the present invention without departing from the apparent scope hereof.

What is claimed is:

1. A convertible beverage container apparatus, comprising:

(a) a container having:

(i) first and second opposed open ends;

(ii) a cylindrical portion;

(iii) a neck portion disposed between said first open end and said cylindrical portion;

(iv) a flange adjacent to said first open end; and (v) a threaded portion adjacent to said second open end;

(b) a handle member that is selectively and separately engageable with a non-dispensing one of said first and second open ends, said handle member having:

(i) a first portion having an inner surface that is circumferentially parallel and propinquit to an outer surface of said cylindrical portion of said container about at least 180° circumference of said cylindrical portion, said first portion including a series of circumaxially spaced-apart circumferential grooves; and (ii) a second portion having a first annular cavity that is threadably engageable with said threaded portion of said container and sealingly engageable with said second open end of said container, and a second cylindrical cavity having a locking groove disposed in a sidewall thereof for engagement with said flange of said container.

2. A convertible beverage container apparatus, comprising:

(a) a container having:

(i) first and second opposed open ends;

(ii) a cylindrical portion;

(iii) a neck portion disposed between said first open end and said cylindrical portion;

(iv) a flange adjacent to said first open end; and (v) a threaded portion adjacent to said second open end;

(b) a handle member that is selectively and separately engagable with a non-dispensing one of said first and second open ends, said handle member having:

(i) a first portion having an inner surface that is circumferentially parallel and propinquity to an outer surface of said cylindrical portion of said container, and one or more deployable grips pivotally secured to said handle member along a longitudinal axis parallel to a container axis extending between said first and second open ends; and (ii) a second portion having a first annular cavity that is threadably engagable with said threaded portion of said container and sealingly engagable with said second open end of said container, and a second cylindrical cavity having a locking groove disposed in a side wall thereof for engagement with said flange of said container.

3. A convertible beverage container apparatus as in claim 2 wherein said deployable grips each include a vertical member spaced-from said longitudinal axis, said vertical members being selectively engageable with one another when said deployable grips are in a deployed position.

* * * * *